US005433187A

United States Patent [19]

Hayasaka et al.

[11] Patent Number: 5,433,187

[45] Date of Patent: Jul. 18, 1995

[54] DIAMOND CUTTING SAW BLADES

[75] Inventors: Kenji Hayasaka; Seiya Ogata; Yoji Niizawa; Hiroyuki Funahashi, all of Fukuoka, Japan

[73] Assignee: Noritake Diamond Industries Co., Ltd., Fukuoka, Japan

[21] Appl. No.: 216,397

[22] Filed: Mar. 23, 1994

[30] Foreign Application Priority Data

Nov. 30, 1993 [JP] Japan ..... 5-299284

[51] Int. Cl.[6] ..... B28D 1/12

[52] U.S. Cl. ..... 125/15; 125/22; 451/547

[58] Field of Search ..... 125/12, 15, 22; 451/541, 547

[56] References Cited

U.S. PATENT DOCUMENTS

| | | | |
|---|---|---|---|
| 618,524 | 1/1899 | Shettleworth | 125/22 |
| 626,533 | 6/1899 | Forster | 125/22 |
| 1,029,406 | 6/1912 | Stagnes | 451/547 |
| 2,049,874 | 4/1936 | Shenk | 451/547 |
| 2,085,722 | 7/1937 | Amrein, Jr. | 125/22 |
| 2,811,960 | 11/1957 | Fessel | 125/15 |
| 3,196,584 | 7/1965 | Tatko | 125/15 |
| 3,338,230 | 8/1967 | Lindblad | 125/15 |
| 4,550,708 | 11/1985 | Roemmele et al. | 125/15 |
| 4,940,039 | 7/1990 | Buettner | 125/15 |
| 5,193,280 | 3/1993 | Jackson | 125/22 |

FOREIGN PATENT DOCUMENTS 61-35742 3/1986 Japan .

62-172560 11/1987 Japan .

*Primary Examiner*—Maurina T. Rachuba

*Attorney, Agent, or Firm*—Keck, Mahin & Cate

[57] ABSTRACT

In a diamond cutting saw blade, a plurality of slits 1 are formed at regular intervals on the outer periphery of a disc-shaped iron substrate 2, and a plurality of segment chips 3 are fixed onto the outer periphery of the disc-shaped iron substrate 2. Two trapezoidal concave portions 4 which expand outwardly are formed on both sides of the outer periphery of each segment chip 3. Further, a trapezoidal concave portion 5 is formed at the intermediate position of the segment chip 3 on a joint surface of the iron plate 2 so as to expand toward the joint surface. At the corner where a bottom surface **4*a* and a tapered surface (side surface) 4*b* of the concave portion 4 formed on the outer periphery intersect, there is formed a curved surface 4*c* having a radius of 1.0 to 2.5 mm. Similarly, in a concave portion 5 formed in the inner periphery of the segment chip 3, there is formed a curved surface 5*c* having a radius of 1.0 to 2.5 mm at the corner where a bottom surface 5*a* and a tapered surface (side surface) 5*b*** intersect each other.

9 Claims, 2 Drawing Sheets

DIAMOND CUTTING SAW BLADES

BACKGROUND OF THE INVENTION

1. Field of the Invention:

The present invention relates to a diamond cutting saw blade for cutting concrete, asphalt, stone and other materials.

2. Discussion of the Related Art:

There has been known a conventional diamond cutting saw blade in which a plurality of segment chips are fixed to the outer periphery of a disc-shaped iron substrate.

The diamond cutting saw blade of this segment type is superior to that of the continuous type, in which a diamond segment layer is fixed to the overall outer peripheral surface of a substrate, in the emission of cutting powder (dust) produced when cutting, because the former has the action of slits formed between the segment chips.

However, even in this segment type, complete emission of the cutting powder is difficult, so a cutting saw blade with superior emission of cutting powder is desired.

In such a diamond cutting saw blade, a lot of frictional heat is generated when cutting. This phenomenon more remarkably occurs in the intermediate region of the segment chip, causing burning of the cutting saw blade, lowered cutting capability, and the like.

Under the above circumstance, various attempts to solve the above problems with the conventional device have been conducted. For example, Utility Model Unexamined Publication No. Sho 61-35742 discloses a cutting saw blade in which a concave portion is defined in the outer periphery of a segment chip. With such a construction, the cutting powder emitting effect can be improved to some degree.

However, the concave portion disclosed by the above publication has a square cross section where the bottom surface and the side surface of the concave portion intersect each other, and cutting powder is liable to remain in the corner where the bottom surface and the side surface intersect each other, hindering the effective emission of cutting powder. Moreover, in such a construction, the temperature rise in the center of the segment chip cannot be abated.

Ways this problem can be solved include subdividing the segment into several parts so that the number of slits is increased, or widening the slits. However, when widening the slits, the segment chip intermittently abuts against an object to be cut when cutting, causing vibration. When increasing the number of slits, the length of the segment chip per one is made shorter in such a manner that the adhesion area of the chip and iron substrate is reduced, thereby making it difficult to maintain a safe fixing force.

For that reason, the present inventors and other persons have proposed in Japanese Utility Model Unexamined Publication No. Sho 62-172560, that each of the concave portions formed on both ends of the outer periphery of a segment chip are of a trapezoidal concave portion which expands outwardly, and a cool water supply concave portion is defined approximately on the intermediate position in the inner periphery of the segment chip. In such a concave structure, the cutting powder during cutting is liable to be discharged outwardly along the tapered surface of the trapezoid, thereby enabling an improvement in the emission of cutting powder.

According to recent research in this field, it has been found that cutting powder still remains in the corner where the bottom surface and the side surface of the trapezoidal concave portion formed in the segment chip intersect each other, so that it cannot be completely emitted. In particular, there is a case where when cutting hard concrete, stress in the corner where the bottom surface and the side surface of the trapezoidal concave portion intersect results in the concave portion cracks and being damaged.

SUMMARY OF THE INVENTION

Therefore, an object of the present invention is to enhance the emission of cutting powder in the trapezoidal concave portion which has been already proposed, and also to improve the strength thereof.

The object of the invention has been achieved by provision of a diamond cutting saw blade in which trapezoidal concave portions which expand outwardly are formed on both sides in the outer periphery of a segment chip which is fixed to the outer periphery of a disc-shaped substrate, characterized in that a curved surface having a radius of 1.0 to 2.5 mm is formed at the corner on the bottom surface of the trapezoidal concave portion.

If the radius of the curved surface is less than 1.0 mm, the emission of the cutting powder and the strength of the segment chip are not much different from those of the conventional cutting saw blade. If the radius is within the range of 0 to 2.5 mm, the emission of the cutting powder and the strength of the segment chip are improved as the radius is enlarged. However, when the radius of the curved surface exceeds 2.5 mm, the emission of the cutting powder remains unchanged and the strength of the segment chip is likely to be lowered.

To reduce the temperature in the center of the segment chip, at the approximate intermediate position of the segment chip a cooling water supply concave portion is formed on the adhesion portion, between the segment chip and the substrate. A curved surface having a radius of 1.0 to 2.5 mm may be formed in the corner on the bottom surface of the cooling water supply concave portion.

It is preferable that the overall length of the opening bottom portion of the trapezoidal concave portion in the front surface side is within 25% of the length of the segment chip, and the depth of the concave portion is within 70% of the height of the segment chip. If the overall length of the opening portion exceeds 25% thereof, the occupation rate of the segment chip portion to the blade outer periphery, that is, demerits such as deterioration of the blade life due to decrease of the chip ratio, exceed the chip wear restraining effect. If the depth of the concave portion exceeds 70% thereof, the strength of the segment chip divided by the concave portion is lowered.

The curved surface having a radius of 1.0 to 2.5 mm is formed in the corner on the bottom surface of the trapezoidal concave portion so that the cutting powder remaining in the corner is smoothly moved onto a tapered surface of the trapezoidal concave portion without being stagnated, and then discharged outwardly. Moreover, the shock caused by cutting does not concentrate at one point of the corner, but is dispersed.

BRIEF DESCRIPTION OF THE DRAWINGS

Other objects, advantages and features of the invention will be apparent when carefully reading the following detailed description in connection with the accompanying drawings, in which:

FIG. 2(*b*) is an enlarged area showing a trapezoidal concave portion located on an outer periphery of each segment chip.

FIG. 2(*c*) is an enlarged area showing a trapezoidal concave portion of the segment chip on a joint surface of the iron plate.

FIG. 4(*b*) is a front view showing the testing unit of FIG. 4(*a*).

DETAILED DESCRIPTION OF THE PREFERRED EMBODIMENTS

Figure 1:
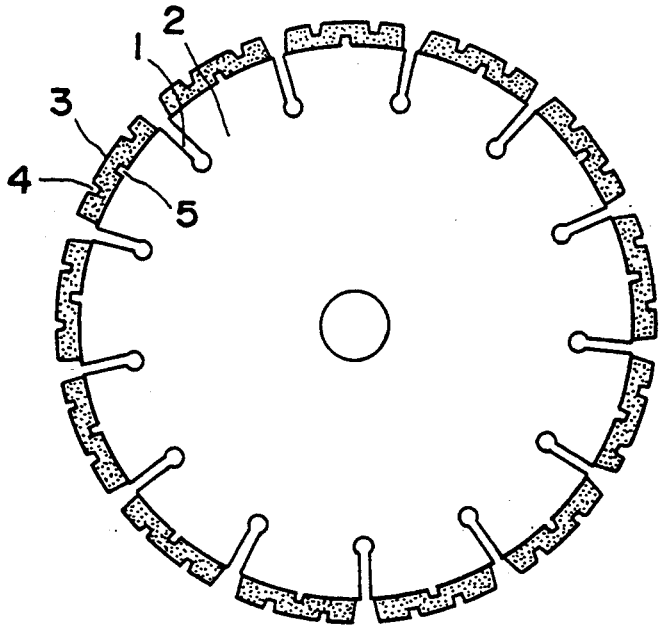
FIG. 1 is a plan view showing an overall diamond cutting saw blade in accordance with one embodiment of the present invention.
Figure 2:
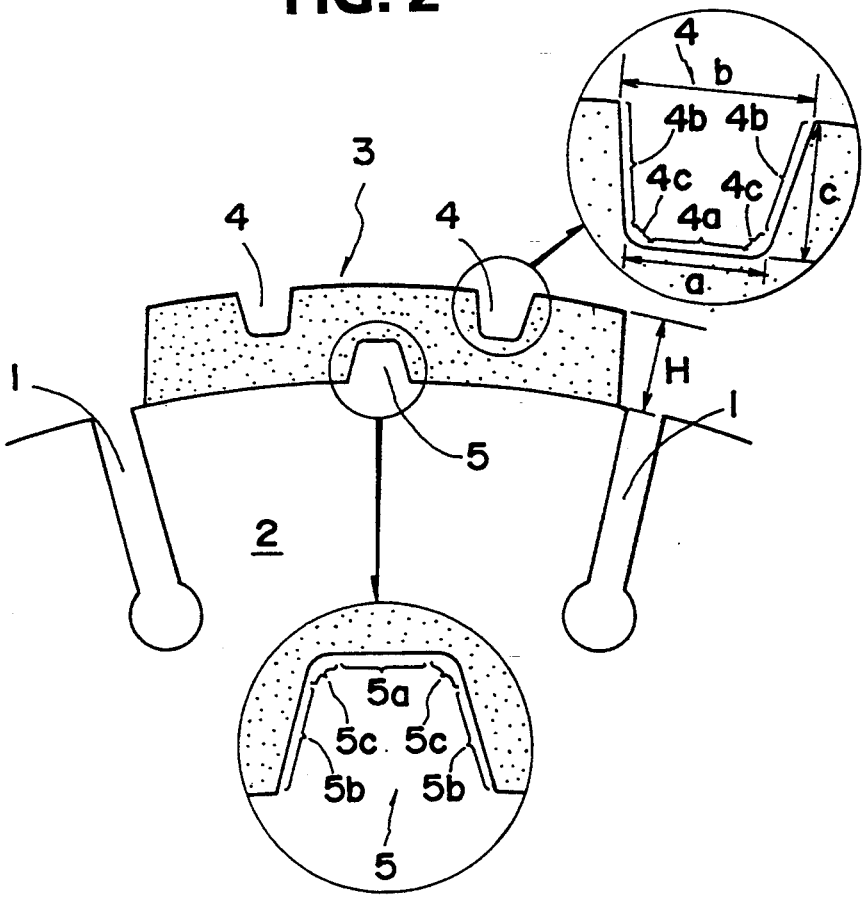
FIG. 2(*a*) is a partially enlarged diagram showing the diamond cutting saw blade of FIG. 1.

FIG. 1 shows a plan view of an overall diamond cutting saw blade in accordance with one embodiment of the present invention, and FIGS. 2(*a*, 2(*b*) and 2(*c*) shows an enlarged plan view showing a primary portion of the diamond cutting saw blade of FIG. 1.

As shown in these figures, in the diamond cutting saw blade, a plurality of slits 1 is formed at regular intervals on the outer periphery of a disc-shaped iron substrate 2, and a plurality of segment chips 3 is fixed onto the outer periphery of the disc-shaped iron substrate 2. Two trapezoidal concave portions 4 which expand outwardly are formed on both sides of the outer periphery of each segment chip 3. Further, a trapezoidal concave portion 5 is formed at the substantially intermediate position of the segment chip 3 on a joint surface of the iron plate 2 so as to expand toward the joint surface.

Referring to the enlarged figure of FIGS. 2(*a*) and 2(*b*), at the corner where a bottom surface 4*a* and a tapered surface (side surface) 4*b* of the concave portion 4 formed on the outer periphery intersect each other, there is formed a curved surface 4*c* having a radius of 1.0 to 2.5 mm. The overall length a of the bottom surface of the concave portion 4 is 8% of the overall length L of the segment chip 3, and the outer width b of the former is 12% of the latter. The depth c of the former is 55% of the height H of the segment chip 3. Referring to the enlarged illustration in FIGS. 2(*a*) and 2(*c*), in the concave portion 5 formed in the inner periphery of the segment chip 3, there is formed a curved surface 5*c* having a radius of 1.0 to 2.5 mm at the corner where a bottom surface 5*a* and a tapered surface (side surface) 5*b* intersect each other.

Fixing the segment chip 3 to the iron substrate 2 may be performed by soldering or laser welding.

In the case of soldering, using a high-frequency induction heating unit or an oxygen-acetylene burner, the peripheral edge of the iron substrate 2 and the segment chip 3, which constitute adhesive portions, are heated to 700° to 800° C., so as to allow silver soldering to be melted. Thereafter, they are cooled to room temperature. In the case of laser welding, after the temperature of the adhesive portion reaches 1500° C., they are cooled to the room temperature.

Thus, the curved surface 4*c* is formed at the corner where the bottom surface 4*a* and the tapered surface (side surface) 4*b* of the concave portion 4 formed in the outer periphery of the segment chip 3 intersect each other in such a manner that the cutting powder is smoothly moved toward the tapered surface 4*b* of the trapezoidal concave portion 4 without stagnating. As a result, it can improve the emission of cutting powder better than the conventional diamond cutting saw blade with the trapezoidal concave portion. Furthermore, the shock caused when cutting does not concentrate at one point of the corner of the trapezoidal concave portion 4, but is dispersed, thereby enabling an improvement in strength.

Further, the conçave portion 5 is formed on the intermediate position of the segment chip 3 so that a cooling water transmitted along the sides of the substrate 2 can be efficiently supplied during the cutting work, thereby enabling the center portion of the segment chip 3, whose temperature is likely to go up in the conventional saw blade, to be effectively cooled. Moreover, the curved surface 5*c* is formed at the corner in such a manner that the shock caused when cutting does not concentrate at one point of the corner of the trapezoidal concave portion, but is dispersed.

Figure 3:
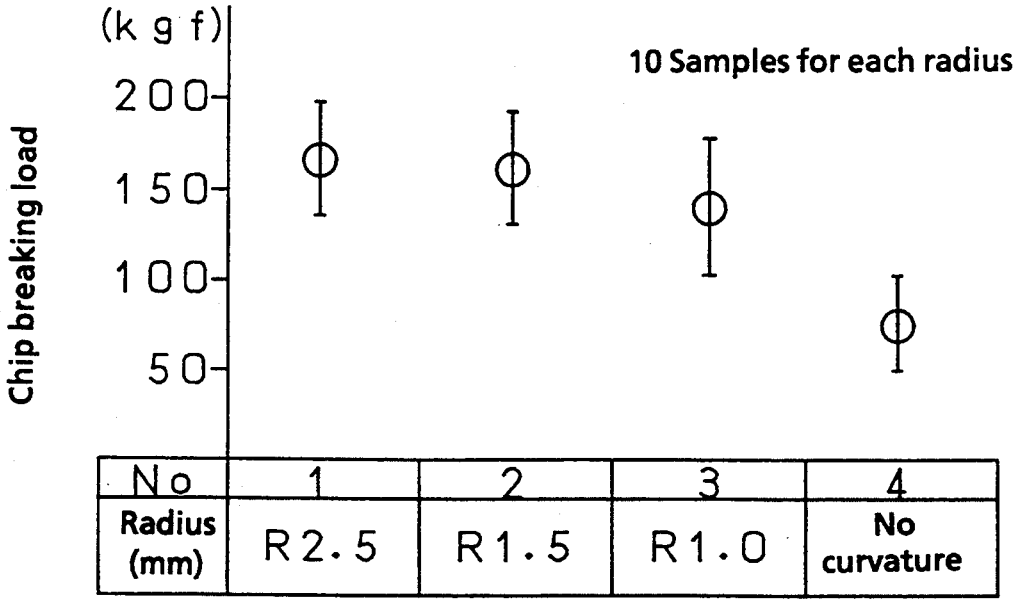
FIG. 3 is a graph representing the change in chip strength depending on the radius (R) of the curved surface.
Figure 4A:
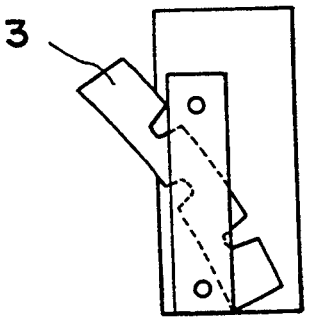
FIG. 4(*a*) is a plan view showing a testing device for testing the strength of the segment chip.
Figure 4B:
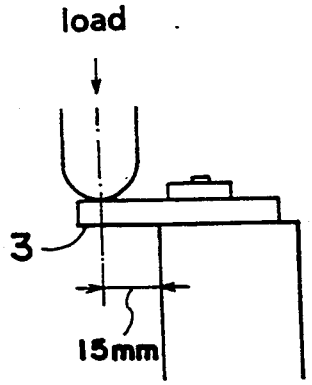

FIG. 3 is a graph representative of the relationship between the radius (R) of the curved surface and the blade strength, and as shown in FIG. 4, using an Auto-Graph IS-2000 Type Transverse Rupture Testing Device made by Simadzu Corp., a load was given to the segment chip 3 to measure the chip breaking load.

As shown in FIG. 3, it has be recognized that, when a curved surface having a radius of 1.0 mm or more is formed, the strength of the segment chip is improved.

In order to recognize the effect of the present invention, using, as one example of the invention, a blade of $372^D \times 47^L \times 3.2^T \times 9.0^X$ having a concave portion in which a curved surface having a radius of 1.5 mm is formed, and, as a comparative example, the conventional blade of the same sizes but without provision of a curved surface in the concave portion, the following experiment has been conducted.

Cutting Conditions:

(1) Machine: Truck-typed engine cutter
Output: 35 Horsepower
Main Spindle Revolution Number Per Minute: 2100 rpm (2) Object to be Cut: Concrete pavement Pressure Withstand Strength: 350 kgf/cm$^2$ (3) Cooling Water Quantity: Supply water from flanges on both sides of a blade at 1.5 liters per minute.

(4) Depth of Cut: 100 mm

The result was that, in the example of the invention, the mean cutting speed was 1.4 m/min, the blade lifetime was 340 m, and the quantity of cutting powder remaining in a cut groove was 490 g/m. In the comparative example, the mean cutting speed was 1.1 m/min, the blade lifetime was 280 m, and the quantity of cutting powder remaining in a cut groove was 630 g/m. Thus, the product of the present example has demonstrated superiority in the emission of cutting powder, cutting speed, and blade lifetime.

With the above organization, the present invention has the following advantages.

(1) A curvature having a radius of 1.0 to 2.5 mm is formed om the corner on the bottom surface of the trapezoidal concave portion in such a manner that cutting powder is smoothly moved to the tapered surface of the trapezoidal concave portion without stagnating, and then discharged outwardly. Moreover, the shock when cutting does not concentrate at one point of the corner, but is dispersed, thereby improving the emission and the strength.

(2) A curved surface having a radius of 1.0 to 2.5 mm is formed in the corner on the bottom surface of the cooling water supply concave portion formed in the adhesive portion with the substrate, thereby enabling the segment chip to be effectively cooled while maintaining the strength.

(3) Since the emission of cutting powder is improved and the cutting powder remaining in the cut groove is minimalized, the segment wear due to cutting powder is reduced so that the blade life can be extended.

(4) Resistance due to cutting powder remaining in the cut groove is reduced, and the efficiency of the blade is improved.

The foregoing description of preferred embodiments of the invention has been presented for purposes of illustration and description. It is not intended to be exhaustive or to limit the invention to the precise form disclosed, so modifications and variations are possible in light of the above teachings, or may be acquired from use of the invention. The embodiment was chosen and described in order to explain the principles of the invention and its practical application to enable one skilled in the art to utilize the invention in various embodiments and with various modifications as are best suited to the intended use. It is intended that the scope of the invention be defined by the claims appended hereto, and their equivalents.

What is claimed is:

1. A diamond cutting saw blade, comprising:

a disc-shaped substrate; and a plurality of abrasive segments fixed to an outer periphery of said disc-shaped substrate, each of said abrasive segments having at least one trapezoidal concave portion which expands outwardly on both sides of an outer periphery of said abrasive segment;

wherein a curved surface having a radius of 1.0 to 2.5 mm is formed in a corner on a bottom surface of said trapezoidal concave portion.

2. A diamond cutting saw blade as claimed in claim 1, wherein a cooling water supply concave portion is formed in the substantial center of said abrasive segment on an adhesive portion with said substrate, and a curved surface having a radius of 1.0 to 2.5 mm is formed in a corner on a bottom surface of said cooling water supply concave portion.

3. A diamond cutting saw blade as claimed in claim 1, wherein two trapezoidal concaves portion are formed on both sides of the outer periphery of said abrasive segment.

4. A diamond cutting saw blade as claimed in claim 1, wherein said substrate is made of iron.

5. A diamond cutting saw blade as claimed in claim 4, wherein said abrasive segments are fixed to said substrate by soldering.

6. A diamond cutting saw blade as claimed in claim 4, wherein said abrasive segments are is fixed to said substrate by laser welding.

7. A diamond cutting saw blade as claimed in claim 1, wherein the overall length of the bottom surface of said concave portion is 8% of the overall length of said abrasive segment.

8. A diamond cutting saw blade as claimed in claim 1, wherein the outer width of said concave portion is 12% of the overall length of said abrasive segment.

9. A diamond cutting saw blade as claimed in claim 1, wherein the depth of said concave portion is 55% of the height of said abrasive segment.

* * * * *